United States Patent [19]

Shapiro

[11] 4,336,817

[45] Jun. 29, 1982

[54] UMBRELLA HAVING A POCKET COMPARTMENT

[76] Inventor: Rosella Shapiro, 3530 Lakeshore Dr., Chicago, Ill. 60603

[21] Appl. No.: 143,865

[22] Filed: Apr. 25, 1980

[51] Int. Cl.[3] ..... A45B 25/00; A45B 25/12

[52] U.S. Cl. ..... 135/16; 135/37

[58] Field of Search ..... 135/16, 20 R, 25, 33, 135/34, 36, 37, 66; 150/35, 43

[56] References Cited

U.S. PATENT DOCUMENTS

| | | | |
|---|---|---|---|
| 276,457 | 4/1883 | Odiorne | 135/37 X |
| 1,287,596 | 12/1918 | Weinberg | 135/36 F |
| 2,681,070 | 6/1954 | D'Ippolito | 135/16 |
| 3,379,201 | 4/1968 | Lynch | 135/33 C |

FOREIGN PATENT DOCUMENTS

| | | | |
|---|---|---|---|
| 7476 | 5/1888 | United Kingdom | 135/66 |

*Primary Examiner*—J. Karl Bell

*Attorney, Agent, or Firm*—Davis, Hoxie, Faithfull & Hapgood

[57] ABSTRACT

An umbrella having a pocket or purse compartment as a part thereof. The pocket consists of first and second lengths of fabric of substantially the same width and length, secured in overlapping relationship and attached at one end thereof to the fabric cover of the umbrella. A length of zipper tape is secured to one of the lengths of fabric so that the lengths of fabric and zipper tape form a pocket or purse compartment for money and the like within the lengths of fabric.

15 Claims, 3 Drawing Figures

UMBRELLA HAVING A POCKET COMPARTMENT

BACKGROUND & SUMMARY OF THE INVENTION

The invention is in the field of umbrellas providing protection against rain and other elements. It is particularly concerned with an improved umbrella construction having an attached pocket or purse compartment as a part thereof.

When going out in the rain or other inclement weather, there is often a need to conveniently carry a small amount of paper money, change, credit cards, tokens, keys and a variety of similar type items. The present invention is directed to that need by the provision of a convenient and inexpensive means of carrying money or other items in a concealed pocket of an umbrella.

One embodiment of the invention is a device which comprises a portable fold-up type umbrella, including a handle, an extending telescopic shaft, a frame and a fabric or plastic water-repellent cover for protection against the rain. An elongated band, made of water-repellent fabric or plastic, secured at one of its outer ends to the cover, or directly to a rib of the umbrella, maintains the umbrella closed in its folded collapsed position by means of an attached snap fastener at its second unsecured outer end, and a complementary snap fastener on the band near its attached end.

The band, of generally rectangular shape, may be constructed of first and second elongated lengths of fabric, substantially the same width and length, and positioned in overlapping relationship therewith. The two lengths of fabric are secured together by stitching means along its outer edges at the ends and longitudinal sides. At one end, the fabric lengths of the band are stitched together to the cover, or directly to a rib of the umbrella, thereby forming a pocket or purse compartment within the confines of the lengths of fabric.

Positioned inwardly of and substantially parallel to the longitudinal side edges of the second fabric length, an elongated zipper tape which can be selectively opened and closed, allows for the selective opening and closing of the pocket within the fabric lengths.

The length of the fabric band may be tautly drawn around the umbrella to lie against the cover when the umbrella is in its collapsed position, and the complementary snap fasteners on the band are attached to hold the umbrella collapsed. Since the zipper lies on the inner side of the band, it will be concealed in this position to hide the pocket from view.

The fabric band may also be tautly drawn and snapped to lie against the fabric cover when the umbrella is in an open position. In this condition, a snap fastener attached to the band is attached to a complementary snap fastener secured at a proper location to the outer exposed side of the fabric cover, so that the pocket compartment is not visible when the umbrella is in its open operative condition.

DETAILED DESCRIPTION

Figure 1:
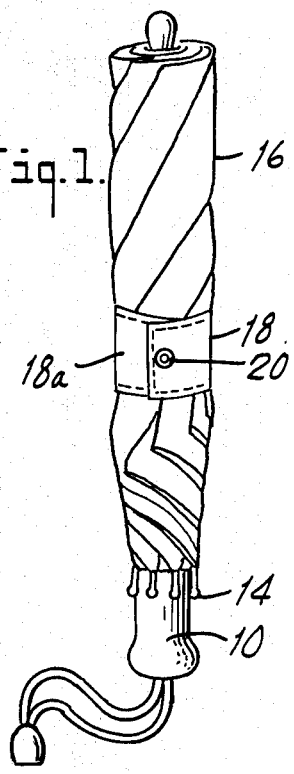
FIG. 1 is a perspective view of an umbrella device in its folded collapsed condition in accordance with the invention.
Figure 2:
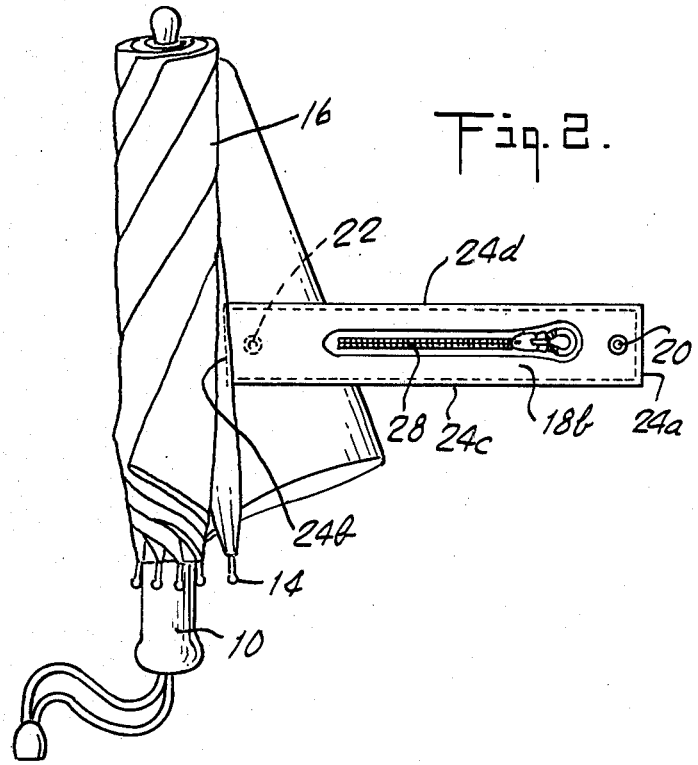
FIG. 2 is a perspective view of the device in a partially unfolded condition.
Figure 3:
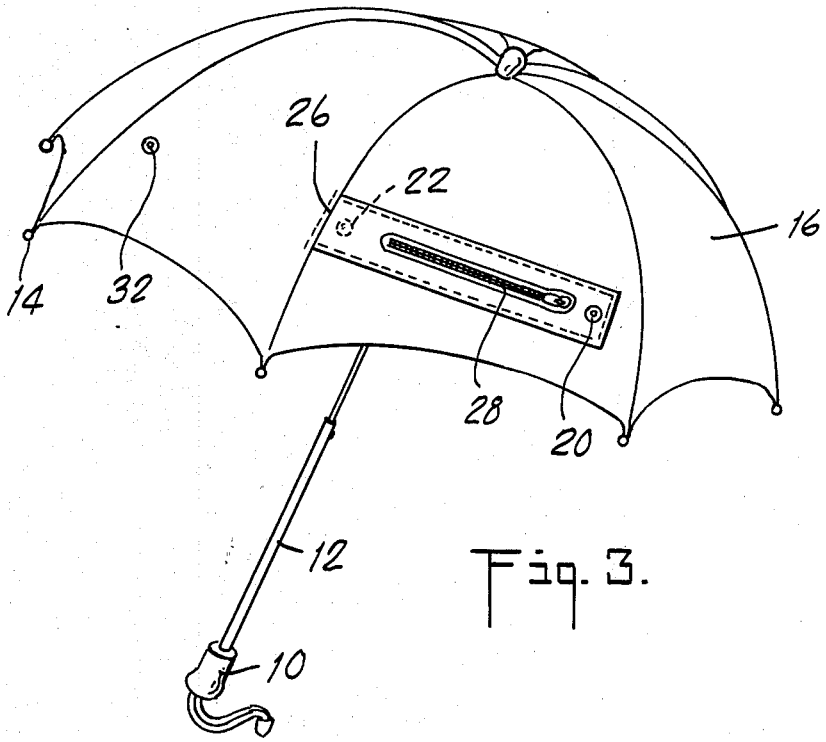
FIG. 3 is a perspective view of the device in its operative condition.

Referring to FIGS. 1, 2 and 3, a portable, fold-up type umbrella comprises a handle 10, an extending telescopic shaft 12, a frame 14 consisting of a plurality of ribs (only partially shown), and a fabric water-repellent cover 16 generally constructed of eight stitched together wedge-shaped sections, for protection against the rain and elements. An elongated fabric band 18, secured at one of its outer ends to the fabric cover 16, or directly to a rib 14 of the umbrella, maintains the umbrella closed in its folded collapsed position (shown in FIG. 1) by means of a snap fastener 20 attached to the band 18 near its unsecured second outer end and a complementary snap fastener 22, longitudinally spaced apart and also attached to the band 18 near its secured end.

The fabric band 18, of generally rectangular shape, having opposed, spaced apart, outer ends **24*a* and 24*b*, and opposed, spaced apart, longitudinal side edges 24*c* and 24*d*, may be constructed of a first elongated length of fabric 18*a* and a second elongated length of fabric 18*b* substantially the same width and length as fabric 18*a* and positioned in overlapping relationship therewith. The fabrics 18*a* and 18*b* are secured together by stitching means along the unattached outer end 24*a*, and longitudinal side edges 24*c* and 24*d*. At the outer end 24*b*, the fabrics 18*a* and 18*b* are stitched together with the fabric cover 16 at an edge 26 of two wedge-shaped sections, or directly to a rib 14 of the frame, thereby forming a pocket or purse compartment within the confines of the lengths of fabric 18*a* and 18*b* for carrying various items such as paper money, coins, credit cards, keys and similar type items. A variety of solid or multicolored fabrics may be used in the fabric band 18, that may or may not match the fabric cover 16**.

Alternatively, the fabric band 18 may be constructed from an integral length of elongated fabric which is folded back in either a longitudinal or transverse direction in substantially overlapping relationship. The corresponding outer ends and side edges including the fold, of the resulting fabric formed, may be secured together by stitching means.

Positioned inwardly of and substantially parallel to the longitudinal side edges **24*c* and 24*d* of fabric length 18*b*, an elongated zipper tape 28 having side edges of fabric and zipper teeth which can be selectively opened and closed, allows for the selective opening and closing of said pocket within the fabric lengths 18*a* and 18*b*. The zipper tape 28 extends substantially across the length of a narrow opening in fabric 18*b*, and is secured in underlapping relationship therewith, by suitable means, such as stitching. When the fabric cover 16 is of a solid color, the fabric band 18 and the zipper tape 28** may be of the same solid color.

The length of the fabric band 18 may be tautly drawn around the umbrella to lie against the fabric cover 16 when the umbrella is in its collapsed position, and the snap fastener 20 and complementary snap fastener 22 on the fabric band 18 are attached to hold the umbrella collapsed. Since the zipper tape 28 lies on the inner side of fabric band 18, it will be concealed in this position. The fabric band 18 may also be tautly drawn and snapped to lie against the fabric cover 16 when the umbrella is in an open position. In this condition, the snap fastener 20 attached at the unsecured outer end **24*a* of the band 18 is attached to a complementary snap fastener 32 secured at a proper location to the outer exposed side of fabric cover 16, so that the pocket compartment is not visible when the umbrella is in its open operative position. Alternatively, a fabric band (not shown) may be tautly drawn and snapped to lie against the inner side of fabric cover 16 when the umbrella is in an open operative condition. As a further alternative, the fabric band 18 may be doubled over on itself when the umbrella is in an open position. In this condition, a double-ended snap fastener (not shown) attached to the band 18 near its secured end and snap fastener 20 may be attached to hold the band 18 doubled over, so that the zipper tape 28** will be concealed.

While the preferred embodiment of the device has been disclosed, it is to be understood that the invention is not limited to the exact embodiment disclosed and that various changes and modifications may be made within the scope of the invention as defined by the claims.

I claim:

1. An umbrella construction having a pocket compartment comprising:

a shaft;

a frame secured at one end to the shaft;

a water-repellent material cover attached to the shaft and the frame;

a first length of water-repellent material having spaced apart outer ends and longitudinal edges;

a second length of water-repellent material, having spaced apart outer ends, longitudinal edges and a longitudinally extending slit, said second length of water-repellent material having substantially the same width and length as the first length of material and positioned in overlapping relationship therewith, said lengths of material secured together at substantially their outer ends and longitudinal edges and secured to said material cover; and closure means secured to said second length of material and positioned in relationship with said slit, so that said lengths of material and said closure means form a pocket or purse compartment for money and the like within the confines of the lengths of material, said pocket being capable of being selectively opened and closed by the selective opening and closing of said closure means.

2. An umbrella construction as in claim 1, wherein the material lengths are secured to said material cover at substantially one outer end and further including fastener means secured to at least one of said lengths of material at substantially the second outer end thereof and complementary fastener means secured to said material cover and positioned such that when said umbrella is in its operative position the second material length and associated closure means are juxtaposed against said material cover thereby concealing said closure means.

3. An umbrella construction as in claim 2, wherein said lengths of material are secured to the exposed outer side of the material cover and said fastener means comprises a snap fastener secured to at least the second length of material and said complementary fastener means comprises a complementary snap fastener on the exposed outer side of said material cover.

4. An umbrella construction as in claim 1, including fastener means and complementary fastener means both of which are secured to at least one of said material lengths and longitudinally spaced apart so that the material lengths hold the umbrella taut when in its folded collapsed position.

5. The umbrella construction of claim 1, wherein the securing together of material is effected by stitching means.

6. The umbrella construction of claim 1, wherein the closure means comprises a length of elongated zipper tape positioned inwardly of and substantially parallel to the longitudinal edges of said second material length.

7. The umbrella construction of claim 6, wherein said material cover, lengths of material and zipper tape are all constructed of materials of substantially the same color.

8. An umbrella having a pocket comprising:

a shaft;

a frame secured at one end to the shaft;

a water-repellent material cover attached to the frame;

a length of water-repellent material separate from said cover forming a pocket enclosed on all sides within said separate material;

said separate material having edges which lie contiguous one another to form an opening into said pocket, for the insertion of objects into said pocket;

closure means for said opening;

means for fixedly attaching said length of separate material to said cover; and fastening means for detachably attaching said length of material to said cover at a point spaced from said attaching means to conceal said opening and closure means.

9. An umbrella as in claim 8, wherein said material length has spaced apart outer ends and longitudinal edges and is fixedly attached to said cover at substantially one outer end, and said fastening means is secured to said length of material at substantially the second outer end thereof, and further including complementary fastening means secured to said cover and positioned such that when said fastening means and the complementary fastening means are engaged said opening is juxtaposed against said cover thereby concealing it from view.

10. An umbrella construction as in claim 9, wherein said length of material is secured to the exposed outer side of the cover and said fastener means comprises a snap fastener secured to at least one of the outer surface portions and said complementary fastener means comprises a complementary snap fastener on the exposed outer side of said cover.

11. An umbrella construction as in claim 8, including fastener means and complementary fastener means both of which are secured to at least one outer surface portion and longitudinally spaced apart so that the material length holds the umbrella taut when in its folded collapsed position.

12. The umbrella construction of claim 8, wherein the closure means comprises a length of elongated zipper tape positioned inwardly of and substantially parallel to the longitudinal edges of said material length.

13. An umbrella having a pocket comprising:

a shaft;

a frame secured at one end to the shaft;

a water-repellent material cover attached to the frame;

a separate length of water-repellent material secured to said cover, the material being folded and stitched so as to form a pocket enclosed on all sides within said separate material, and having an opening therein for placement of items within or removal of items from the pocket; and fastening means for detachably attaching said length of material to said cover to conceal said opening.

14. An umbrella comprising:

a shaft;

a frame secured at one end to the shaft;

a water-repellent material cover attached to the frame;

a separate length of water-repellent material having spaced apart outer ends, longitudinal edges and a longitudinally extending slit, the material folded back upon itself so that the outer edges are doubled over and the longitudinal edges touch one another;

means to join the doubled over outer edges and the touching longitudinal edges, thereby forming a pocket with an opening defined by the longitudinal slit, through which items may be placed within or removed from the pocket;

means to secure the separate material to the cover; and fastening means for detachably attaching said length of material to said cover to conceal said longitudinal slit.

15. An umbrella as in claim 14, further including closure means for the opening.

* * * * *